US007134749B2

(12) United States Patent
Ben-Zur et al.

(10) Patent No.: US 7,134,749 B2
(45) Date of Patent: Nov. 14, 2006

(54) METHOD FOR IMAGE PRINTING ON A DARK TEXTILE PIECE

(75) Inventors: Ofer Ben-Zur, Raanana (IL); Yossef Pearl, Tel-Aviv (IL)

(73) Assignee: Kornit Digital Ltd., Moshav Magshimim (IL)

( * ) Notice: Subject to any disclaimer, the term of this patent is extended or adjusted under 35 U.S.C. 154(b) by 3 days.

(21) Appl. No.: 10/461,414

(22) Filed: Jun. 16, 2003

(65) Prior Publication Data

US 2004/0252173 A1 Dec. 16, 2004

(51) Int. Cl.
*B41J 2/01* (2006.01)

(52) U.S. Cl. ..... 347/101; 347/100

(58) Field of Classification Search ..... 347/101, 347/100, 43, 105, 96, 98, 102, 95; 428/195, 428/32.1; 156/1; 427/1; 106/31.6, 31.13, 106/31.27; 523/160

See application file for complete search history.

(56) References Cited

U.S. PATENT DOCUMENTS

| | | | | |
|---|---|---|---|---|
| 4,021,591 | A | 5/1977 | DeVries et al. | |
| 4,630,076 | A * | 12/1986 | Yoshimura | 347/43 |
| 4,702,742 | A * | 10/1987 | Iwata et al. | 347/101 |
| 5,501,902 | A | 3/1996 | Kronzer | |
| 5,510,415 | A | 4/1996 | Zahrobsky et al. | |
| 5,798,179 | A | 8/1998 | Kronzer | |
| 6,087,061 | A | 7/2000 | Hare et al. | |
| 6,126,281 | A * | 10/2000 | Shimoda et al. | 347/101 |
| 6,267,518 | B1 | 7/2001 | Abe | |
| 6,513,924 | B1 * | 2/2003 | Goldberg et al. | 347/102 |
| 2002/0060728 | A1 * | 5/2002 | Koizumi et al. | 347/101 |
| 2003/0157304 | A1 * | 8/2003 | Li et al. | 428/195 |

FOREIGN PATENT DOCUMENTS

| | | |
|---|---|---|
| GB | 422488 | 1/1935 |
| WO | 9830749 | 7/1998 |
| WO | 9956948 | 11/1999 |
| WO | 0073570 | 12/2000 |
| WO | 0117792 | 3/2001 |
| WO | 0132974 | 5/2001 |
| WO | 02066565 | 8/2002 |

* cited by examiner

*Primary Examiner*—Manish S. Shah

(57) ABSTRACT

A method and apparatus for color printing on a dark textile piece, the method including the steps of digitally applying a white ink layer directly onto a textile piece, optionally curing the white ink layer, and digitally printing a colored image on said ink layer.

7 Claims, 8 Drawing Sheets

Side View

Top View

METHOD FOR IMAGE PRINTING ON A DARK TEXTILE PIECE

FIELD OF THE INVENTION

This invention describes a system and method for printing digital images on textile pieces, and in particular, to an inkjet method for printing digital images on dark and colored textile pieces.

BACKGROUND OF THE INVENTION

Inkjet printing on textile pieces is well known. In the direct printing method, the "construction" of the image is achieved by placing ink drops on the textile at different adjacent sites as discreet, physically non-mixed drops. In the transfer method, the colored image is first applied on the transfer media (paper that has very low affinity to the ink). The colored image is dried and then transferred to the textile piece, as by various heat transfer processes. This printing method is satisfactory for printing on light colored textile pieces. The human eye includes cells, called cones, which are sensitive to light of a particular range of wavelengths, and respond to blue light, green light and red light. All other colors we see are combinations of these three colors.

In imaging systems, colors can be mixed in different ways to produce a desired result for the eye. The mixing method commonly used in printing is known as subtractive primary colors model. In the subtractive color mixing process, colors are mixed, for example, from the primary colors cyan, magenta and yellow, using a process of subtraction or filtering. The color perceived is not generated directly by the object we observe, but rather the color seen is the result of the surrounding light being reflected off the printed ink surface, or transmitted to the substrate surface and reflected back to the viewer through the ink. The ink absorbs some, but not all of the light wavelengths, reflecting or allowing transmission of the rest. As a result, the ink film serves as a filter that selectively subtracts certain colors.

Opaque inks reflect light wavelengths, while transparent inks transmit light wavelengths to the substrate. Therefore, when using transparent inks, the substrate color is usually opaque white, or at least light. In that case, the viewer receives the reflected light from the substrate. For example, if a white substrate is painted with blue transparent ink, the ink layer absorbs the ambient light, allowing only the blue light to be transmitted to the substrate. The blue light is then reflected by the opaque white substrate, back through the ink and into the viewer's eyes, and perceive by the viewer as blue color.

However, colored images on colored backgrounds can rarely be distinguished. This is due to the fact that light impinging on the dark textile is not reflected towards the eyes of the viewer. Rather, if the substrate base color is dark, then transmitted light will be absorbed and not reflected by the substrate, and the viewer will not see the light. Thus, printing on a dark garment is not available using digital devices, such as color copiers, ink-jet printers, laser printers and the like.

SUMMARY OF THE INVENTION

There is thus provided, according to the present invention, a method for printing directly on dark textile pieces including the steps of digitally printing a white masking layer onto a dark textile piece, curing the masking layer, and digitally printing an image directly onto same dark textile piece above the masking layer.

According to one embodiment, the digital printing process includes digitally printing a white masking layer by means of an inkjet printer onto a dark textile piece, drying and fixing the image, and digitally printing a colored image by means of an inkjet printer onto a dark textile piece above said masking layer.

Further according to the present invention, there is provided an apparatus for printing directly on a dark textile piece. The device includes a printing table for holding a textile piece, at least one white inkjet head and at least one color inkjet print head, and preferably an array of inkjet print heads including a plurality of color print heads and at least one white inkjet head, disposed above the printing table, and a controller for causing printing of a white colored masking layer on top of the textile piece on the printing table during a first pass, or series of passes, for activating the drying unit to dry the masking layer, and for causing printing of a color image printing on top of the dried masking layer on the printing table during a second pass, or series of passes.

According to one embodiment, the apparatus further includes a drying unit above the printing table.

There is also provided, according to the present invention, a method for printing on dark textile pieces including the steps of digitally printing an image onto transfer paper, applying a white masking layer that covers the image, and transferring by heat transfer the image and masking layer from the transfer paper to a dark textile piece.

According to one embodiment, the step of digitally printing includes digitally printing an image by means of an inkjet printer onto transfer paper, and curing and fixing the image.

According to one embodiment of the invention, the method further includes the step of applying a layer of adhesive onto the masking layer, before the step of transferring.

Further according to the present invention, there is provided an apparatus for printing on a dark textile piece, the device including a rotating drum for holding transfer paper, at least one color inkjet print head and at least one white inkjet print head, and preferably an array of inkjet print heads including a plurality of color print heads and at least one white inkjet head, disposed adjacent the rotating drum, and a controller for causing color image printing on a transfer paper on the drum during a first rotation, or series of rotations, for activating the curing unit to cure the color image, and for causing printing of a white colored masking layer on top of the dried color image on the transfer paper on the drum during a second rotation, or series of rotations.

According to one embodiment, the apparatus further includes a drying unit disposed adjacent the drum.

Preferably, the apparatus further includes a heat transfer unit for transferring the color image and masking layer from the transfer paper onto a dark textile piece.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a method and apparatus for textile digital ink printing for image application on a dark or colored textile piece. In particular, the invention relates to direct image application on a dark textile piece, as well as to textile digital ink printing for transfer image application on a dark textile piece. In this invention, the emphasis is on dark textile print, because printing on light colored fabric is a much simpler task.

Figure 1:
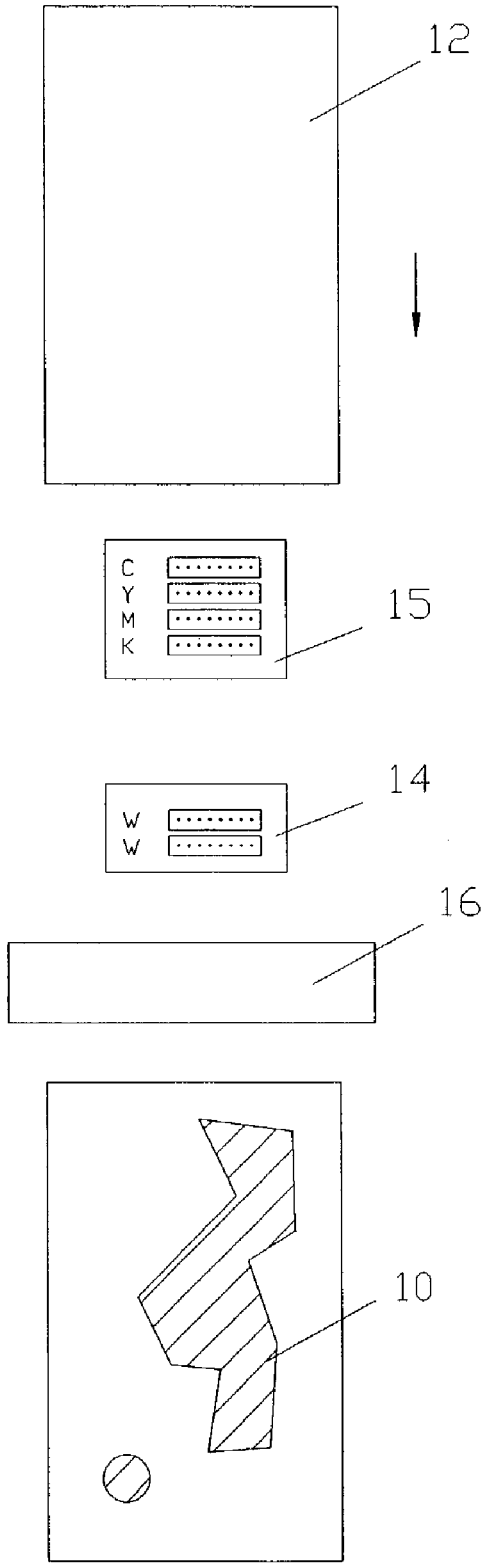
FIG. 1 is a schematic illustration of the image printing process according to one embodiment of the invention.
Figure 2:
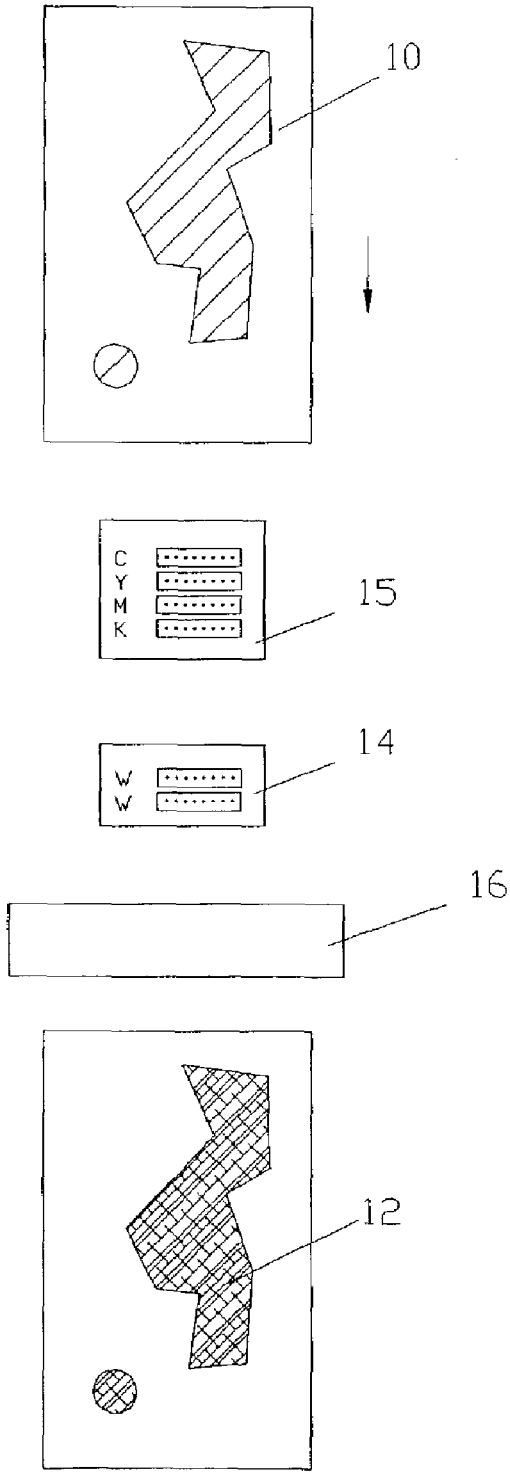
FIG. 2 is a schematic illustration of the masking layer printing process according to one embodiment of the invention.

Referring now to FIG. 1, there is shown a schematic illustration of the image printing process according to one embodiment of the invention, for printing an image directly onto the textile piece 12. The process begins by printing, by means of at least one white inkjet head, here illustrated as an array of inkjet heads 14 with white ink, a layer of white opaque ink that covers the designed image area, to form a masking layer 10. During the printing process, the white masking layer 10 is preferably cured and fixed by a curing unit 16, to prevent its dissolution with the next image layer. This can be accomplished in any conventional manner, such as UV curing lamp, IR, hot air, etc., depending on the specific ink type and application. The masking layer is then over printed, by means of at least one color inkjet head, here shown as a second array of inkjet heads 15 with colored ink, in a second printing process, shown schematically in FIG. 2, with the desired color image. It will be appreciated that the image may be all of a single color, or a many colors. In a case where curing is performed immediately (like UV curing or hot melt solidification), the procedure can be carried out in a single printing process, as color inkjet heads array 15 fires ink drops just after white inkjet heads array 14 has left a cured masking layer on the substrate.

Preferably, the white ink is placed exactly on the designed image area, in order to cover it completely, but not to exceed it. For the white layer only, "bleeding" in between the adjacent drops is not an issue, therefore the ink may be applied in a dense manner to assure good coverage. Printing resolution of the white ink can be lower than the resolution of the process colors, and the drop size can be larger, to reduce printing time. As has been previously explained, the white ink preferably is placed on the textile by means of an array of white printing heads 14. Preferably, a controller (not shown) controls both the process color printing heads and the white printing heads, so as to coordinate the printing and ensure precise coverage of the entire image, but not more.

Figure 3:
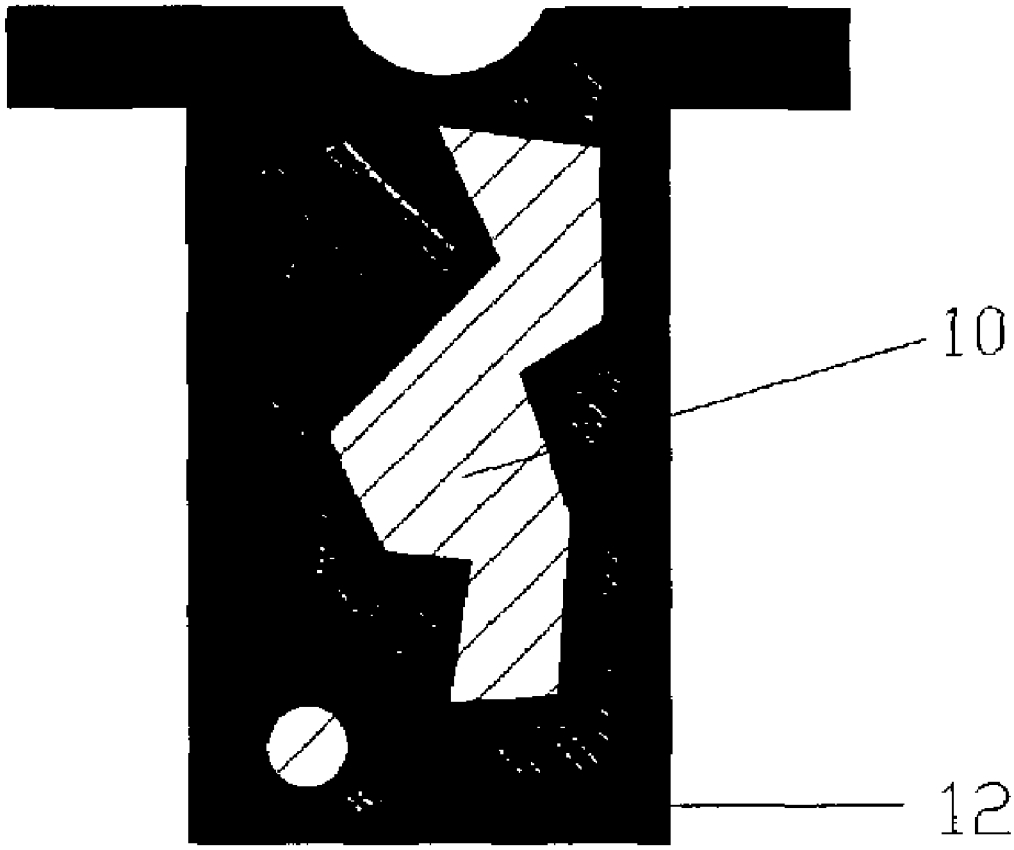
FIG. 3 is an illustration of a dark textile piece after image printing.

The "construction" of the image is achieved by placing ink drops at different adjacent sites as discreet, physically non-mixed drops. In the illustrated embodiment, the image is printed by an array of printing heads 15. For example, the image is printed with subtractive primary colors: Cyan, Yellow, Magenta, and Black (CYMK), using transparent ink. The white opaque color layer now reflects all light that is transmitted through the image ink layers, and the viewer can observe the image 12 as if it had been printed on a white color garment, as illustrated in FIG. 3.

There are several types of inks that can be utilized in this invention. In order to suit inkjet applications, the ink should posses the following characteristics:

1. The viscosity profile must provide the highest temperature and response to shear sensitivity, i.e. the ink will be as viscous as possible at ambient temperatures (but not too viscous for the circulation system and filters) and about 8–18 cp (as required by OEM Drop On Demand (DOD) print head jetting conditions (temperature, shear stress)). The high viscosity at ambient temperature ensures also shelf stability, while the low viscosity is recommended for reliable print-head operation.
2. The surface tension at jetting should be about 28–32 dyn/cm$^2$ (as required by OEM DOD print heads).
3. The ink will neither react while inside the print head nor dry on the orifice plate, to prevent clogging.
4. On media: The ink should not bleed or feather after application, to ensure a sharp and bright image. This is preferably achieved by fast fixation and/or short curing time, so as not to delay application of subsequent layers, and to prevent bleeding of the colors into each other or the masking layer.
5. The ink should have low shrinkage after application and curing.
6. The image layer should have strong adhesion to the media.

Useful ink types are categorized according to their curing mechanism:

UV and/or Visible light curing: the dry image layer is formed immediately as a result of exposure of the applied ink layer to UV and/or Visible light only.

IR curing: the dry image layer is formed upon exposure of the applied ink layer to IR radiation only.

Thermal/heat curing: the dry image layer is formed as a result of a relatively fast chemical reaction on the media between the applied ink's components at elevated temperatures only.

Air/heat-drying: the dry image layer is formed due to solvents and/or water evaporation. The evaporation takes place at ambient temperature, and can be accelerated at higher temperatures.

Air/moisture curing: the dry image is formed as a result of a chemical reaction of the applied ink with air moisture.

Solidification: the solid ink is melted at elevated temperatures and immediately forms a solid layer after it solidifies again at ambient temperature.

Room temperature chemical curing: the dry image layer is formed due to a relatively slow chemical reaction between the applied ink's components at room temperature, and or a fast chemical reaction at higher temperatures.

Figure 4:
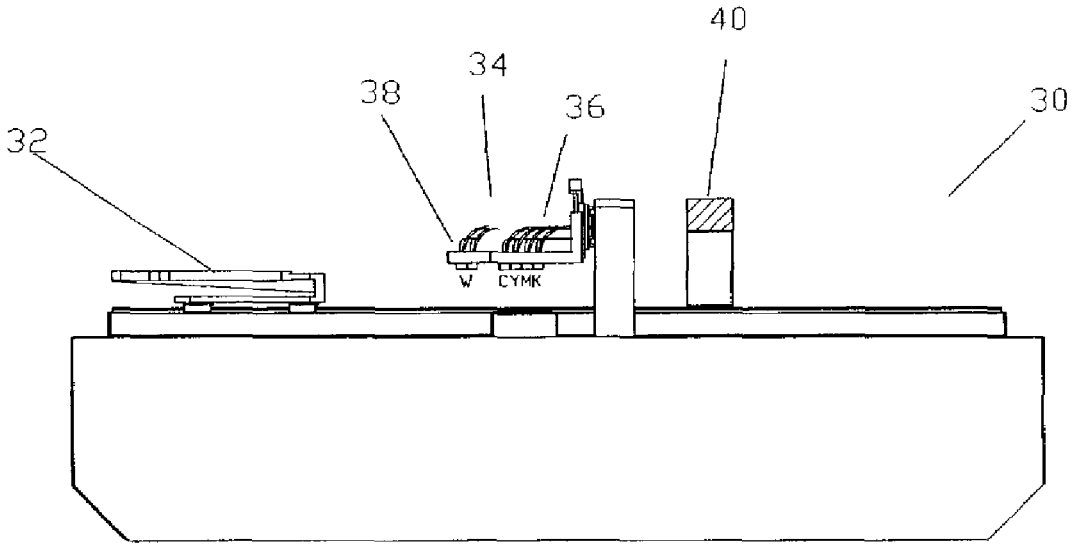
FIG. 4 is a schematic illustration of a apparatus for direct inkjet printing on a dark textile piece constructed and operative in accordance with one embodiment of the present invention.
Figure 4:
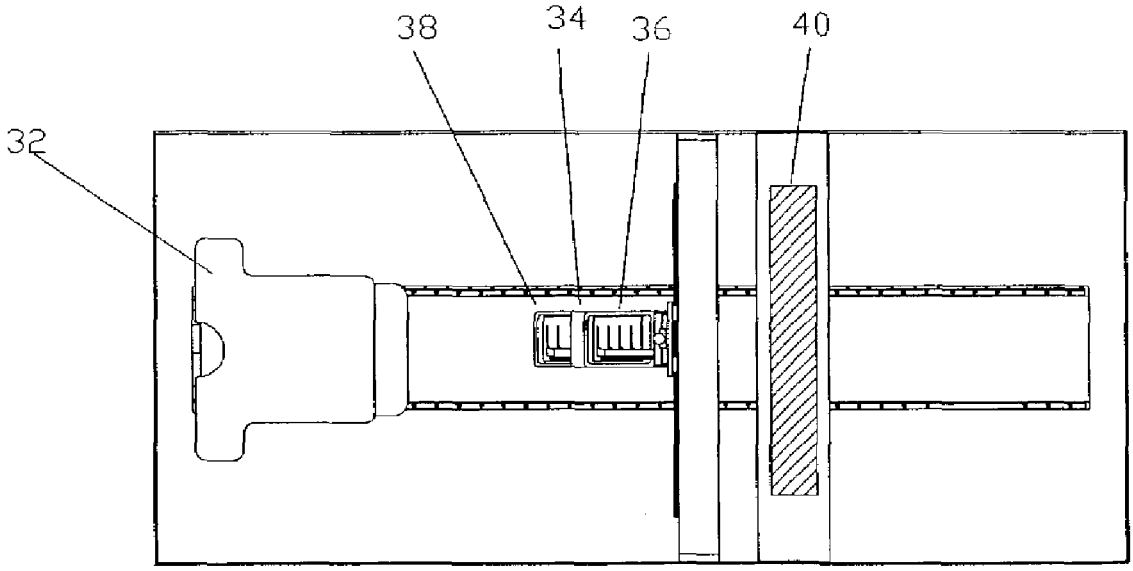

FIG. 4 is a schematic illustration of an apparatus 30 for direct ink-jet printing on a dark textile piece, constructed and operative in accordance with one embodiment of the present invention. Apparatus 30 includes a printing table 32 for holding a textile piece, and an array of inkjet print heads 34 disposed above the printing table. The print heads include a plurality of color print heads 36 and one or more white inkjet heads 38. (Alternatively, a single color inkjet print head and a single white inkjet print head could be utilized.) Preferably, a curing unit 40 is also disposed above the printing table, for curing ink deposited by the inkjet printing heads on a textile piece on the table, although, alternatively, the ink could be allowed to dry and cure by itself with time. A controller 42 (not shown) is coupled to the apparatus 30 for causing printing of a white colored masking layer on a textile piece on the printing table during a first pass, or series of passes, for activating the curing unit to cure the color image, and for causing printing of a color image on top of the cured masking layer on the textile piece on the table during a second pass, or series of passes.

Figure 5:
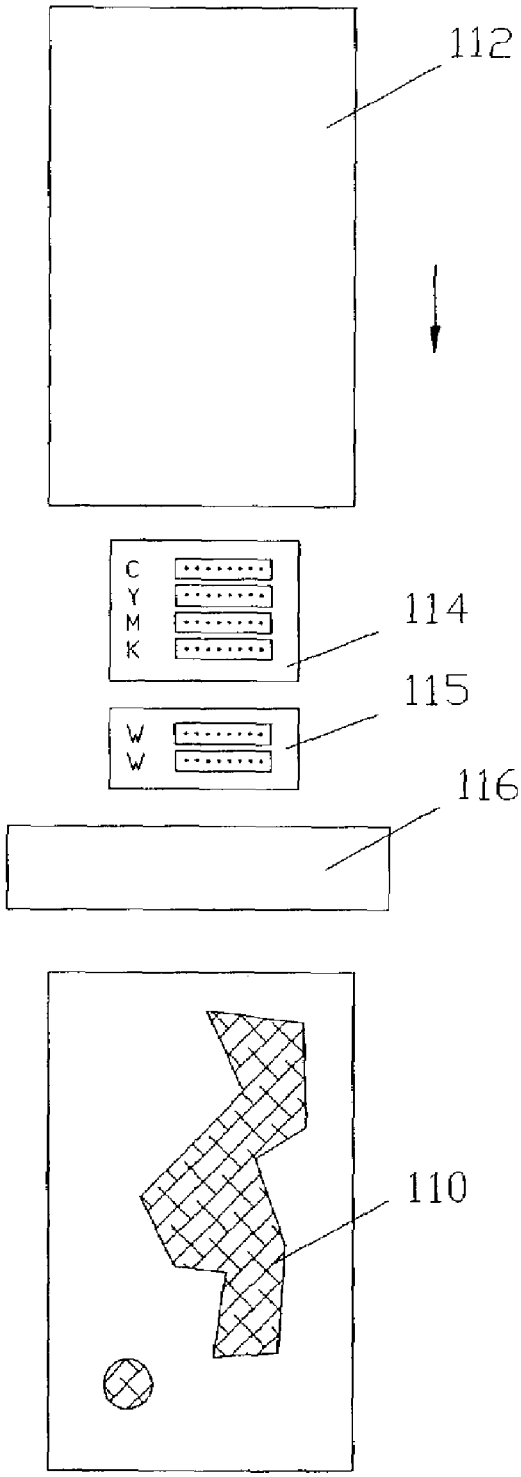
FIG. 5 is a schematic illustration of the image printing process according to an alternative embodiment of the invention.

Referring now to FIG. 5, there is shown a schematic illustration of the image printing process according to an alternative embodiment of the invention, including an image transfer process. The process begins by printing a desired color image 110 onto a transfer media 112 (paper that has very low affinity to the ink). The "construction" of the image is achieved by placing ink drops at different adjacent sites as discreet, physically non-mixed drops. The ink composition used must prevent the drops from "bleeding" on the applied media. In the illustrated embodiment, the image is printed by an array of color printing heads 114. The image is printed using subtractive primary colors: Cyan, Yellow, Magenta, and Black (CYMK), for example, using transparent ink.

Figure 6:
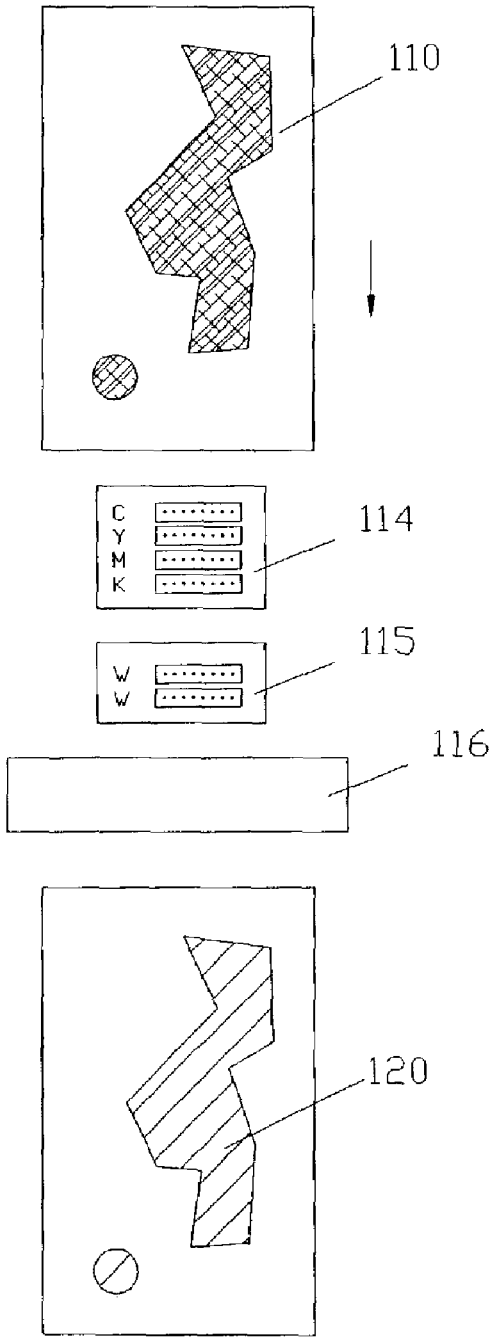
FIG. 6 is a schematic illustration of the masking layer printing process according to one embodiment of the invention.

During the printing process, the colored image is cured and fixed by a curing unit 116 to prevent its dissolution with the next masking layer. This can be accomplished in any conventional manner, such as UV curing lamp, IR, hot air, etc., depending on the specific ink type and application. The image is then over printed by white inkjet heads array 115, in a second printing process shown schematically in FIG. 6, with white opaque ink that covers the image area, to form a masking layer 120.

In a case where curing is performed immediately (like UV curing or hot melt solidification), the procedure can be carried out in a single printing process, as white inkjet heads array 115 fires white ink drops just after colored inkjet heads array 114 has left a colored image on the substrate.

Preferably, the white ink is placed exactly on the image area, in order to cover it completely, but not to exceed it. For the white layer only, "bleeding" in between the adjacent drops is not an issue, therefore the ink may be applied in a dense manner to assure good coverage. Printing resolution of the white ink can be lower than the resolution of the process colors, and the drop size can be larger to reduce printing time. The white ink is placed on the image by means of an array of white printing heads 115. Preferably, both the process color printing heads and the white printing heads are controlled by a controller (not shown), so as to coordinate the printing and ensure precise coverage of the entire image, and no more.

Figure 7:
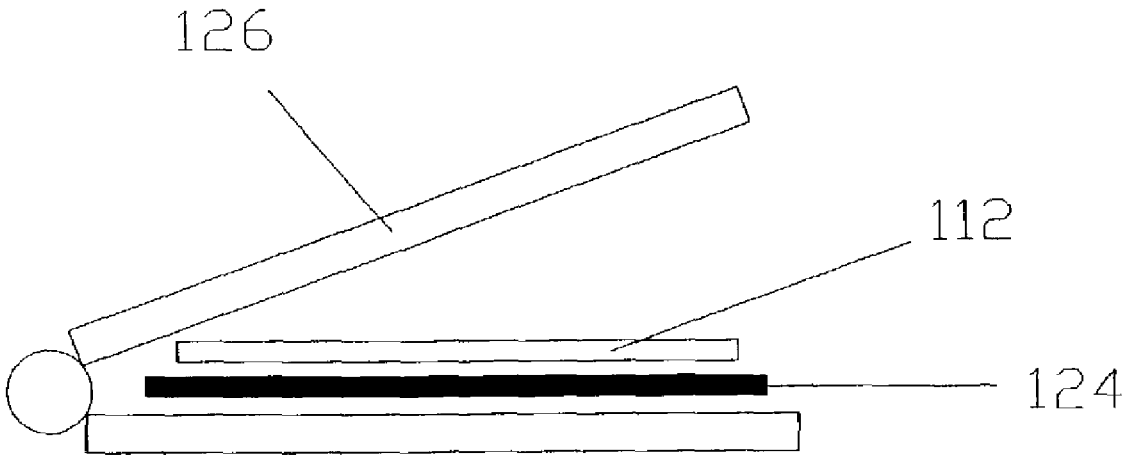
FIG. 7 is a schematic illustration of the heat transfer process according to one embodiment of the invention.

As shown schematically in FIG. 7, the printed transfer paper 112 is now placed on a textile piece 124 in a heat transfer apparatus 126. When the transfer paper is heat pressed against the textile substrate, as known, the white color is transferred onto the textile piece, with the image as the outer layer. The white opaque color layer now reflects all light that is transmitted through the image ink layers, and the viewer can observe the image 110, as illustrated in FIG. 3, as if it had been printed on a white color garment.

It is a particular feature of the invention that this process allows indirect inkjet printing on a substrate of any base color, although the printing process is longer and requires more inkjet nozzles for the white color ink than conventional printing on a light color background. In order to assure durability of the printed image on the textile substrate, a pressure sensitive adhesive is preferably added. Otherwise, the image might be removed during washing, ironing, etc. There are several options for adding the adhesive:

Method 1

A third layer is added above the white masking layer, this layer being of textile pressure sensitive thermally cured adhesive. The adhesive layer covers the two previous layers completely. The adhesive layer is a pressure sensitive one, cured thermally during heat transfer of the image onto the textile piece. The adhesive layer is preferably applied by an inkjet head or by another device, as known in the trade.

Method 2

The adhesive is a part of a binder in the white masking ink formulation. The printed masking layer, itself, therefore performs as the third layer described in Method 1. Other adhesives can be introduced in the white masking ink formulation described in Method 2.

Examples of commercial adhesives suppliers:

1) BOSTIC Inc.—Their Supergrip® reactive hot melts offer a unique combination of hot melt processing and handling with the advantages of a reactive thermosetting, solvent free adhesive, that offer rapid fixing at relatively low temperatures. These adhesives are suitable for Method 1.
2) Clifton Adhesives Inc. offers solution/mixed adhesives based on various rubbers (Neoprene™, Hypalon™, polyester, vinyl, SBR, nitrile, urethane and ethyl vinyl acetate adhesives). These products are easily incorporated into water and solvent based inks, to serve as pressure sensitive adhesives. These adhesives are suitable for use in Method 2.

Figure 8:
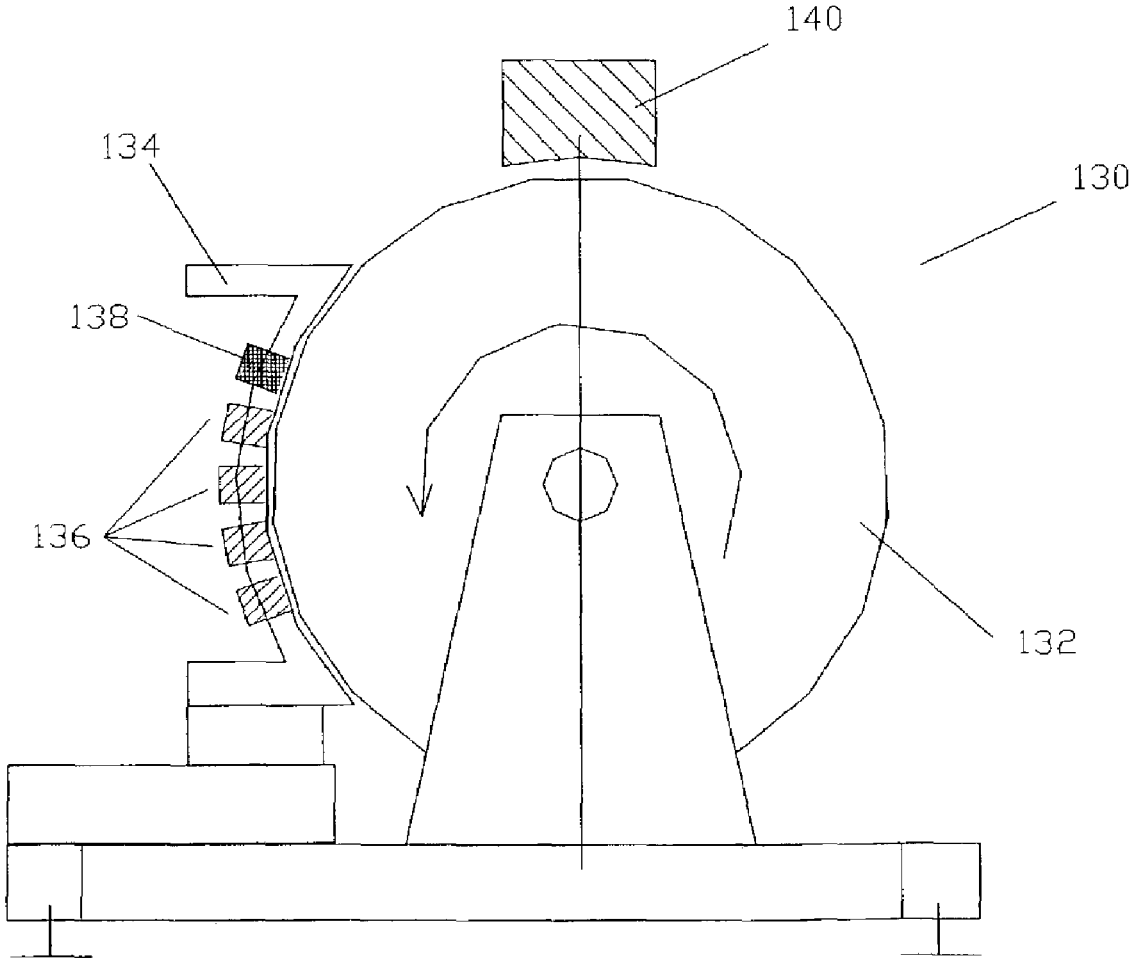
FIG. 8 is a schematic illustration of an apparatus for inkjet printing on a dark textile piece, constructed and operative in accordance with an alternative embodiment of the present invention.

Referring now to FIG. 8, there is shown a schematic illustration of an apparatus 130 for inkjet printing on a dark textile piece constructed and operative in accordance with one embodiment of the present invention. Apparatus 130 includes a rotating drum 132 for holding transfer paper, and an array of inkjet print heads 134 disposed adjacent the rotating drum. The print heads include a plurality of color print heads 136 and at least one white ink-jet head 138. (Alternatively, a single color print head and a single white ink-jet print head could be utilized.) If required by the selected ink, a curing unit 140 may also be disposed adjacent the drum, for curing ink deposited by the ink-jet printing heads on transfer paper on the drum. A controller 142 (not shown) is coupled to the apparatus 130 for causing color image printing on a transfer paper on the drum during a first rotation, or series of rotations, for activating the curing unit to cure the color image, and for causing printing of a white colored masking layer on top of the dried color image on the transfer paper on the drum during a second rotation, or series of rotations. Preferably, the apparatus further includes a heat transfer unit for transferring the color image and masking layer from the transfer paper onto a dark textile piece.

It will be appreciated that the invention is not limited to what has been described hereinabove merely by way of example. Rather, the invention is limited solely by the claims that follow.

The invention claimed is:

1. A method for color printing on a dark textile piece comprising the steps of:

digitally printing, by mean of an inkjet printing head, an opaque white ink layer directly onto a dark textile piece; and digitally printing a colored image on said white ink layer, said digitally printing said white ink layer is performed such that said white ink layer substantially covers, without exceeding, the designed area of said colored image, and further such that said white ink layer and said colored image are substantially coextensive.

2. The method according to claim 1, wherein said step of digitally printing said opaque white ink layer further comprises fixing said layer.

3. The method according to claim 1, further comprising curing said white ink layer before the step of digitally printing said colored image.

4. The method according to claim 3, wherein said step of digitally printing said colored image includes digitally printing a white ink layer by means of an inkjet printing head directly onto the textile piece, and fixing said layer.

5. An apparatus for printing on a dark textile piece, the apparatus comprising:

a flat bed machine with a printing table for holding the dark textile piece;

at least one white inkjet printing head and at least one color inkjet printing head disposed above the printing table and arranged for printing directly on the dark textile piece; and a controller for causing said at least one white inkjet printing head to digitally print an opaque white ink layer directly on the dark textile piece on the printing table during a first pass, or series of passes, and for causing said at least one color inkjet printing head to digitally print a colored image on top of the white ink layer on the textile piece on the printing table during a second pass, or series of passes, such that said white ink layer substantially covers, without exceeding, the designed area of said colored image, and further such that said white ink layer and said colored image are substantially coextensive.

6. The apparatus according to claim 5, further comprising a curing unit associated with said printing table, wherein said controller is also arranged to activate the curing unit to fix at least the white ink layer.

7. The apparatus according to claim 5, further comprising an array of inkjet printing heads including a plurality of color printing heads and at least one or more white inkjet printing head.

* * * * *

US007134749C1

(12) EX PARTE REEXAMINATION CERTIFICATE (8001st)

United States Patent

Ben-Zur et al.

(10) Number: US 7,134,749 C1

(45) Certificate Issued: Jan. 18, 2011

(54) METHOD FOR IMAGE PRINTING ON A DARK TEXTILE PIECE

(75) Inventors: Ofer Ben-Zur, Raanana (IL); Yossef Pearl, Tel-Aviv (IL)

(73) Assignee: Kornit Digital Ltd., Kiryat Arieh, Petach Tikva (IL)

Reexamination Request:
No. 90/009,646, Dec. 24, 2009

Reexamination Certificate for:

| | |
|---|---|
| Patent No.: | **7,134,749** |
| Issued: | **Nov. 14, 2006** |
| Appl. No.: | **10/461,414** |
| Filed: | **Jun. 16, 2003** |

(51) Int. Cl.
*B41J 2/01* (2006.01)

(52) U.S. Cl. ..... 347/101; 347/100

(58) Field of Classification Search ..... None
See application file for complete search history.

(56) References Cited

U.S. PATENT DOCUMENTS

| | | | |
|---|---|---|---|
| 3,968,498 | A | 7/1976 | Uchiyama |
| 4,021,591 | A | 5/1977 | De Vries et al. |
| 4,296,421 | A | 10/1981 | Hara et al. |
| 4,312,007 | A | 1/1982 | Winfield |
| 4,380,770 | A | 4/1983 | Maruyama |
| 4,630,076 | A | 12/1986 | Yoshimura |
| 4,702,742 | A | 10/1987 | Iwata et al. |
| 5,349,021 | A | 9/1994 | Rooney et al. |
| 5,501,902 | A | 3/1996 | Kronzer |
| 5,510,415 | A | 4/1996 | Zahrobsky et al. |
| 5,534,904 | A | 7/1996 | Sheinman |
| 5,582,104 | A | 12/1996 | Best et al. |
| 5,594,044 | A | 1/1997 | Yang |
| 5,631,684 | A | 5/1997 | Takaide et al. |
| 5,645,888 | A | 7/1997 | Titterington et al. |
| 5,757,407 | A | 5/1998 | Rezanka |
| 5,798,179 | A | 8/1998 | Kronzer |
| 5,885,335 | A | 3/1999 | Adams et al. |
| 5,981,113 | A | 11/1999 | Christian |
| 5,988,791 | A | 11/1999 | Miyashita et al. |
| 6,042,228 | A | 3/2000 | Yamada et al. |
| 6,059,391 | A | 5/2000 | Fulkerson et al. |
| 6,087,061 | A | 7/2000 | Hare et al. |
| 6,095,628 | A | 8/2000 | Rhome |
| 6,117,921 | A | 9/2000 | Ma et al. |
| 6,126,281 | A | 10/2000 | Shimoda et al. |
| 6,132,502 | A | 10/2000 | Yatake |
| 6,140,391 | A | 10/2000 | Zou et al. |
| 6,156,072 | A | 12/2000 | Usui et al. |
| 6,161,929 | A | 12/2000 | Erdtmann et al. |

(Continued)

FOREIGN PATENT DOCUMENTS

| | | |
|---|---|---|
| EP | 1281533 | 2/2003 |
| GB | 422488 | 1/1935 |
| JP | 5 293954 | 11/1993 |
| JP | 9 39365 | 2/1997 |
| JP | 10 278379 | 10/1998 |
| JP | 11-138768 | 5/1999 |
| WO | WO 98/30749 | 7/1998 |
| WO | WO 99/56948 | 11/1999 |
| WO | WO 00/73570 | 12/2000 |
| WO | WO 01/17792 | 3/2001 |
| WO | WO 01/32974 | 5/2001 |
| WO | WO 01/49504 | 7/2001 |
| WO | WO 02/066565 | 8/2002 |
| WO | WO 2005/076730 | 8/2005 |
| WO | WO 2005/115089 | 12/2005 |
| WO | WO 2005/115761 | 12/2005 |

OTHER PUBLICATIONS

Boehmite, http://en.wikipedia.org/w/index.php?title=Boehmite&oldid=177322677 (last visited Nov. 30, 2009).

*Primary Examiner*—James Menefee

(57) ABSTRACT

A method and apparatus for color printing on a dark textile piece, the method including the steps of digitally applying a white ink layer directly onto a textile piece, optionally curing the white ink layer, and digitally printing a colored image on said ink layer.

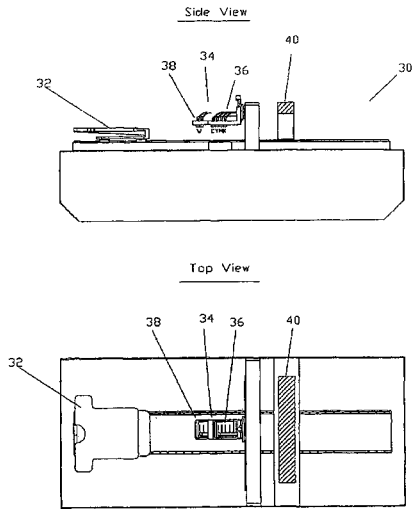

U.S. PATENT DOCUMENTS 6,183,079 B1 2/2001 Meade et al.
6,196,674 B1 3/2001 Takemoto
6,206,516 B1 3/2001 Moriyama et al.
6,262,796 B1 7/2001 Loopstra et al.
6,267,518 B1 7/2001 Abe
6,270,189 B1 8/2001 Miyashita et al.
6,291,023 B1 9/2001 Nigam
6,300,391 B2 10/2001 Parazak et al.
6,322,620 B1 11/2001 Xiao
6,326,419 B1 12/2001 Smith
6,335,140 B1 1/2002 Miyazaki
6,341,856 B1 1/2002 Thompson et al.
6,416,923 B2 7/2002 Miyazaki
6,450,633 B1 9/2002 Kronzer
6,464,649 B1 10/2002 Duchon et al.
6,500,880 B1 12/2002 Parazak
6,513,924 B1 2/2003 Goldberg et al.
6,536,894 B1 3/2003 Rasmussen
6,606,427 B1 8/2003 Graves et al.
6,626,530 B2 9/2003 Snow et al.
6,647,208 B1 11/2003 Kirby
6,698,874 B2 3/2004 Katsuki
6,755,518 B2 6/2004 Codos
6,785,436 B2 8/2004 Ravikanth et al.
6,840,992 B2 1/2005 Glaum et al.
6,879,378 B2 4/2005 Morita et al.
7,134,749 B2 11/2006 Ben Zur et al.
2002/0009662 A1 1/2002 Miyazaki
2002/0022120 A1 2/2002 Katsuki et al.
2002/0060728 A1 5/2002 Koizumi et al.
2003/0142167 A1 7/2003 Nakamura et al.
2003/0157304 A1 8/2003 Li et al.
2003/0197750 A1 10/2003 Iwatsuki et al.
2003/0197772 A1 10/2003 Iwatsuki et al.
2003/0205159 A1 11/2003 McNeil
2004/0252173 A1 12/2004 Ben-Zur et al.
2005/0098054 A1 5/2005 Berndtsson et al.
2005/0179706 A1 8/2005 Childers
2005/0179708 A1 8/2005 Ben-Zur
2007/0103528 A1 5/2007 Pearl et al.
2007/0103529 A1 5/2007 Pearl et al.
2007/0104899 A1 5/2007 Pearl et al.
2008/0012884 A1 1/2008 Ben-Zur et al.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 5 are determined to be patentable as amended.

Claims 2-4 and 6-7, dependent on an amended claim, are determined to be patentable.

New claims 8-11 are added and determined to be patentable.

1. A method for color printing on a dark textile piece comprising the steps of:

digitally printing, by mean of an inkjet printing head, an opaque white ink layer directly onto a dark textile piece; and digitally printing a colored image on said white ink layer, said digitally printing said white ink layer is performed such that said white ink layer substantially covers, without exceeding, the designed area of said colored image, and further such that said white ink layer and said colored image are substantially coextensive,

*wherein the printing resolution of the white ink layer is lower than the printing resolution of the colored layer.*

5. An apparatus for printing on a dark textile piece, the apparatus comprising:

a flat bed machine with a printing table for holding the dark textile piece;

at least one white inkjet printing head and at least one color inkjet printing head disposed above the printing table and arranged for printing directly on the dark textile piece; and a controller for causing said at least one white inkjet printing head to digitally print an opaque white ink layer directly on the dark textile piece on the printing table during a first pass, or series of passes, *at a first resolution,* and for causing said at least one color inkjet printing head to digitally print a colored image on top of the white ink layer on the textile piece on the printing table during a second pass, or series of passes, *at a second resolution,* such that said white ink layer substantially covers, without exceeding, the designed area of said colored image, and further such that said white ink layer and said colored image are substantially coextensive,

*wherein the second resolution is higher than the first resolution.*

*8. The method according to claim 1 wherein digitally printing said color image comprises ink-jet printing.*

*9. The method according to claim 8 and comprising printing of the white layer using an ink drop size that is larger than the ink drop size utilized to print the colored image.*

*10. The apparatus according to 8 wherein the array of printing heads prints the white layer using a larger ink drop size than does the array of print heads in printing the colored image.*

*11. A method for color printing on a dark textile piece comprising the steps of:*

*digitally printing, by mean of an inkjet printing head, an opaque white ink layer directly onto a dark textile piece; and*

*digitally printing a colored image by means of an ink-jet printing head on said white ink layer,*

*said digitally printing said white ink layer is performed such that said white ink layer substantially covers, without exceeding, the designed area of said colored image, and further such that said white ink layer and said colored image are substantially coextensive,*

*comprising printing of the white layer using an ink drop size that is larger than the ink drop size utilized to print the colored image.*

* * * * *